United States Patent [19]

Weimer et al.

[11] Patent Number: 4,463,678

[45] Date of Patent: Aug. 7, 1984

[54] HYBRID SHAPED-CHARGE/KINETIC/ENERGY PENETRATOR

[75] Inventors: Raymond J. Weimer, Burke; Chulho Kim, Alexandria, both of Va.

[73] Assignee: The United States of America as represented by the Secretary of the Navy, Washington, D.C.

[21] Appl. No.: 132,463

[22] Filed: Apr. 1, 1980

[51] Int. Cl.[3] ..... F42B 1/02

[52] U.S. Cl. ..... 102/307; 102/308; 102/309; 102/476

[58] Field of Search ..... 102/24 HC, 56 SC, 307, 102/308, 309, 306, 476

[56] References Cited

U.S. PATENT DOCUMENTS

| | | | |
|---|---|---|---|
| 3,025,794 | 3/1962 | Lebourg et al. | 102/24 HC |
| 3,259,064 | 7/1966 | Owens | 102/24 HC |
| 3,613,585 | 10/1971 | Dubroff | 102/56 SC X |
| 3,661,086 | 5/1972 | Thomanek et al. | 102/24 HC X |
| 3,742,854 | 7/1973 | Donahue et al. | 102/24 HC X |
| 4,109,576 | 8/1978 | Eckets | 102/24 HC X |

*Primary Examiner*—Peter A. Nelson

*Attorney, Agent, or Firm*—Robert F. Beers; William T. Ellis; Philip Schneider

[57] ABSTRACT

This invention is directed to the construction of armor-piercing projectiles which combine the enhanced kinetic energy penetration due to metal matrix composite materials with that of a shaped-charge jet to defeat armor not vulnerable to either weapon alone.

11 Claims, 2 Drawing Figures

HYBRID SHAPED-CHARGE/KINETIC/ENERGY PENETRATOR

Background of the Invention

This invention relates to kinetic-energy penetrators and more particularly to a combination, hybrid, shaped-charge-kinetic-energy penetrator.

It is well known that projectiles may be made with different penetration characteristics and of different sizes. The type of projectile used depends upon the target and the desired damage to be inflicted on the target. Some projectiles, especially armor-piercing types, will penetrate thick walls of steel or at least penetrate to a certain distance with considerable damage. Another type is a shaped-charge jet. Shaped-charge jets require a stand-off distance between the target face and the shaped-charge liner within the projectile in order to form an optimum hypervelocity liquid metal jet that effects penetration of the target. Such penetrators are generally impact-fused and are therefore susceptible to defeat by light spaced armor which can fire the jet at excessive standoff distances. Prefiring of the jet prevents the desired penetration.

Summary of the Invention

This invention combines a metal matrix composite material as a penetrator with a shaped-charge liner which is provided with an inertial fusing means to provide a hybrid shaped-charge/kinetic-energy penetrator. The shaped charge jet is formed at a specific distance from the aft end of the nose or main body of the metal matrix composite material kinetic energy penetrator head. The specific standoff distance required for the shaped-charge liner is assured by utilizing a high-strength metal-matrix composite shell wall between the shaped charge and the kinetic-energy penetrator head. The penetrator will expend its kinetic-energy at the proper timed relationship with the shaped charge such that the shaped-charge jet will continue the penetration of the target.

It is therefore an object of this invention to take advantage of the best performance of a shaped-charge penetrator and of a kinetic-energy penetrator in hybrid fashion to provide a projectile which is superior to either.

Another object is to maintain the optimum standoff distance for the shaped charge liner to provide more effective penetration.

Yet another object is to initiate the shaped charge jet at the proper penetration depth of the kinetic-energy penetrator so that the best of each will be obtained.

Detailed Description

Figure 1:
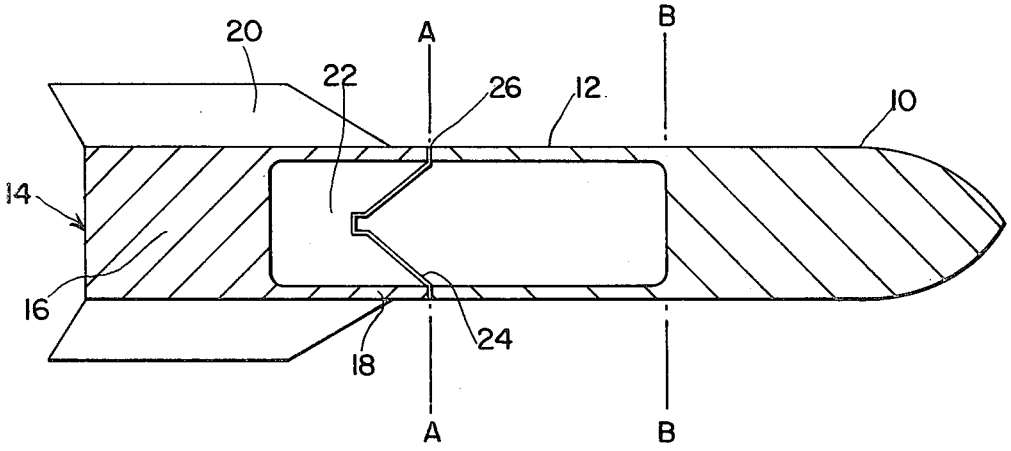
FIG. 1 is a sectional view of a hybrid projectile according to the invention.

This invention will be described by reference to FIG. 1 which illustrates a hybrid-shaped-charge/kinetic-energy penetrator. The hybrid penetrator includes a front or nose section 10, a middle section 12 and an aft inertial-fuse section 14. The nose section is a solid cylindrical section with a pointed forward end. The nose section is made of a high-density composite penetrator material such as tungsten-fiber-reinforced material, such as aluminum, copper, steel, or depleted uranium. The nose section is joined by the middle section which is of tubular construction and formed by a high-strength metal-matrix composite material such as boron-reinforced aluminum to maintain rigidity and structural integrity during impact and penetration of a target.

Figure 2:
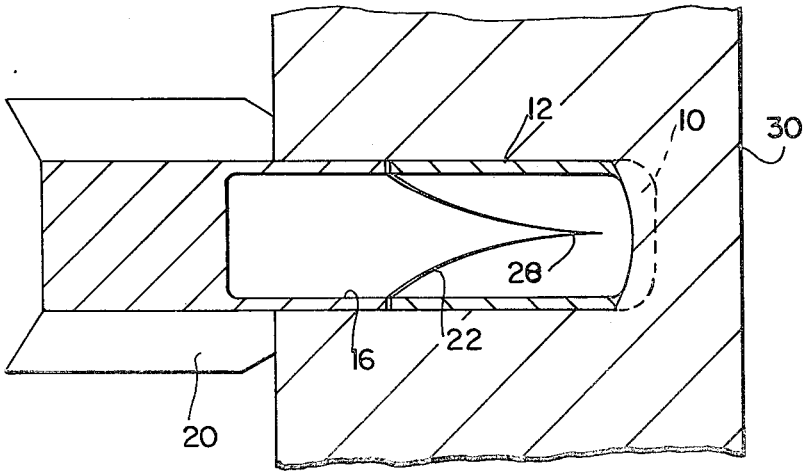
FIG. 2 shows the penetrating effect of the projectile into a target.

The aft section joins with the middle section. The aft section includes a solid end portion 16 which includes an inertial fuse 14 joined with a cylindrical portion 18. Stabilizing fins 20 are secured to the outside surface of the aft section. The cylindrical portion 18 encloses a shaped charge 22 and copper liner 24 which is shaped to properly form a shaped-charge jet discharge 28 of molten copper that travels down the projectile axis at high velocity as shown in FIG. 2. An inertial fuse is used to fire the shaped charge at the proper time.

The spacing between the aft end of the nose section and that of the shaped charge is critical. The spacing should be from $1\frac{1}{2}$ to 2 times the diameter of the shaped charge. Shaped charges are well known in the art and the material composition of the shaped charge forms no part of this invention. Also, inertial fuses are well known in the art and the fuse mechanism is not considered to be a new component of the invention.

In manufacture, the aft section, including the fuse section and shaped-charge section, is formed. The nose section 10 and middle cylindrical section 12 are then formed. The aft section and nose section, are then joined at 26 to form one hybrid projectile.

In making use of the hybrid projectile, the projectile is fired toward a target. The projectile strikes the target 30 and penetrates to a depth in accordance with the toughness of the nose section as shown in FIG. 2. During penetration of the target, forward portion of the nose section will be eroded by a highly localized compression failure mechanism, unique to composite materials, that precludes diametral expansion of the nose section. The nose section is designed to sacrifice about $\frac{3}{4}$ of its length before coming to rest within the target, whereupon it will appear somewhat as shown in FIG. 2. At the instant that the projectile comes to rest, the inertial fuse will ignite the shaped charge. The shaped charge burns to form a liquid-metal jet by effectively squeezing the copper liner through itself as represented in FIG. 2. The high-velocity jet of molten copper, for example, penetrates the remaining portion of the nose section and also penetrates the target.

The hybrid-projectile takes advantage of the penetrating effects of both the nose section penetrator and the liquid metal jet of the shaped-charge penetrator.

The stand off distance of the shaped-charge liner from the aft end of the nose section is $1\frac{1}{2}$ to 2 times the diameter of the shaped charge. More effective penetration by the shaped-charge jet is achieved by using a metal-matrix composite tube to maintain the optimum standoff distance and by using an inertial fuse that does not activate the shaped charge until the nose section has become at rest. The effectiveness of the shaped charge is improved by initiating it deep within the target by using a metal matrix composite precursor as a kinetic energy penetrator. The effectiveness of the shaped charge jet is also improved by directing it into material already intensely heated by the high rate deformation due to the kinetic energy penetrator.

Obviously many modifications and variations of the present invention are possible in light of the above teachings. It is therefore to be understood that within the scope of the appended claims the invention may be practiced otherwise than as specifically described.

What is claimed and desired to be secured by Letters Patent of the United States is:

1. A hybrid projectile which comprises:

a nose section of high density composite material;

a cylindrical middle section in axial alignment with said nose section and joined thereto in end-to-end relationship;

said cylindrical middle section formed of a metal composite unidirectionally reinforced with continuous fibers selected from the group consisting of boron or silicon carbide;

an aft section in axial alignment with said middle section, said aft section including a solid end portion and a cylindrical portion, said cylindrical portion joined in end-to-end relationship with said cylindrical middle section;

a shaped charge confined within said cylindrical portion of said aft section;

shaped-charge liner means enclosed by said shaped charge within said cylindrical portion of said aft section; and inertial fuse means confined within said solid portion of said aft section.

2. A hybrid projectile as claimed in claim 1 in which:

said shaped-charge liner means is located a distance of from 1½ to 2 times the diameter of the shaped charge from the aft end of said nose section.

3. A hybrid projectile as claimed in claim 1 in which:

said nose section is made of a high density metal matrix composite material comprised of a tungsten-fiber-reinforced matrix material selected from the group consisting of aluminum, copper, steel, or depleted uranium.

4. The invention according to claim 1 wherein the nose section is formed of a high density composite metal material of which one component is selected from the group consisting of aluminum, copper, steel or depleted uranium and is reinforced with tungsten fibers for defining a kinetic energy penetrator adapted to penetrate into armor substantially without diametral expansion.

5. The invention according to claims 1 or 4 wherein the cylindrical middle section is in the form of a tube of composite material including aluminum.

6. A hybrid projectile for use against heavy armor which is protected by light armor spaced outwardly therefrom for intercepting incoming projectiles and causing their premature detonation at an ineffective distance from the heavy armor, comprising:

a nose section adapted for penetrating armor;

an aft section carrying a forward facing shaped charge;

a middle section connecting the nose section and aft section resistant to collapse for maintaining the shaped charge face at a desired stand off distance from the rear of the nose section upon penetration of the nose section into heavy armor; and an inertial fuse in the aft section connected with the shaped charge and adapted to activate only upon coming to rest;

whereby the projectile is adapted to pass completely through outwardly spaced light armor without ignition and have its shaped charge ignited only after the nose section has penetrated into the heavy armor and come to rest.

7. The invention according to claim 6 wherein the middle section maintains the face of the shaped charge at a stand-off distance from the aft end of the nose section which is around 1½ to 2 times the diameter of the shaped charge.

8. The invention according to claim 6 or 7 wherein the middle section comprises a cylindrical tubular member axially aligned between the nose section and aft section.

9. The invention according to claim 8 wherein the tubular member is a metal composite including aluminum reinforced with continuous fibers selected from the group consisting of boron or silicon fibers.

10. The invention according to claim 6 wherein the nose section is formed of a high density metal composite.

11. The invention according to claim 6 or 10 wherein the high density metal composite nose section is a tungsten fiber reinforced material selected from the group consisting of aluminum, copper, steel or depleted uranium.

* * * * *